United States Patent [19]

Base

[11] 4,270,619

[45] Jun. 2, 1981

[54] DOWNHOLE STABILIZING TOOL WITH ACTUATOR ASSEMBLY AND METHOD FOR USING SAME

[76] Inventor: Jimmy D. Base, Rt. 1, Box 40M, Stillwater, Okla. 74074

[21] Appl. No.: 81,547

[22] Filed: Oct. 3, 1979

[51] Int. Cl.[3] ..... E21B 7/08

[52] U.S. Cl. ..... 175/61; 175/73; 175/325

[58] Field of Search ..... 175/61, 76, 73, 325, 175/269; 166/212

[56] References Cited

U.S. PATENT DOCUMENTS

| | | | |
|---|---|---|---|
| 3,123,162 | 3/1964 | Rowley | 175/325 |
| 3,370,657 | 2/1968 | Antle | 175/325 X |
| 3,424,256 | 1/1969 | Jeter et al. | 175/76 |
| 3,593,810 | 7/1971 | Fields | 175/76 X |
| 3,974,886 | 8/1976 | Blake, Jr. | 175/76 |
| 4,046,204 | 9/1977 | Takaoka et al. | 175/76 |

*Primary Examiner*—Stephen J. Novosad

*Attorney, Agent, or Firm*—Pravel, Gambrell, Hewitt, Kirk, Kimball & Dodge

[57] ABSTRACT

A downhole stabilizing tool communicating with a fluid conductive drill string having a sleeve assembly mounted for movement within the tool housing between selected positions and having camming members therewith for actuating stabilization pads mounted with the tool housing for lateral movement thereof in response to movement of the sleeve assembly between the selected positions, pawl members with the tool housing for cooperating with the sleeve assembly for limiting movement of the sleeve assembly to the selected positions, and pawl engaging members with the sleeve assembly for limiting movement of the sleeve assembly to the selected positions. The actuator assembly includes a piston body member adapted to be positioned within the stabilizing tool and having programming members therewith for cooperatively engaging compatibly formed engaging surfaces with the stabilizing tool that are also spaced apart a programmed distance for moving the stabilization pads between the selected positions. The method of the present invention includes steps of preprogramming the actuator assembly prior to running the same into the fluid conductive drill string for selectively engaging the stabilizing tool to expand the stabilization pads laterally as desired.

49 Claims, 12 Drawing Figures

A
10c
72
72i
10
12a
10b
12
74f
72j
74a
72k
74u
32c
10i
96b
74b
86a
74p
86b
96
96a
92a
12c
86e
86d
86
H
85
20b
20
86c
94
94a
74n
74
20a
74k
92c
90b
88
90
20c
20d
18b
18a
20e
G
90c
90e
78e
90d
18f
90e
92b
18d
3
3
74v
90a
18g
92
18c
92f
18
74j
74s
92c
74c
74d
92g
74k
74t
92d
74l
74m
76b
76
76a
76d
38
S
38a
18h
32
32a
32b
74g
74e
36
34a
32d
34b 80
10c
10
12a
10b
T
72
10i
32c
12c
12
H
A
32
32a
32b
72i
72k
72j
96c
96b
96
96a
86a
92a
74p
86b
85
86d
74h
18b
86c
74
92h
94
74n
74i
92e
18f
90
88
18g
74v
74j
92f
18c
18
74d
74s
74c
92g
74k
20b
20
20c
20d
18a
20a
20e
18e
90e
18d
38
38a
18h
S
36
34a
32d
34b
G

DOWNHOLE STABILIZING TOOL WITH ACTUATOR ASSEMBLY AND METHOD FOR USING SAME

TECHNICAL FIELD OF THE INVENTION

The technical field of this invention relates to a directional drilling tool utilizing a drill string in a borehole and more particularly to such a tool having an actuator assembly and a method for using same, wherein borehole deviation with respect to the vertical can be controlled to increase, decrease, or maintain the angle of such deviation without removal of the drill string from the borehole.

PRIOR ART

The technology developed with respect to drilling boreholes in the earth has long encompassed the use of various techniques and tools to control the deviation of boreholes during the drilling operation. In some instances, such technology is employed to retard borehole deviation. In other instances, increased directional deviation is desired. However, in almost all instances it has heretofore been necessary to withdraw the drill string assembly from the borehole for the attachment of various specialized tools to achieve the desired objective. The prior art represented by such patents as U.S. Pat. Nos. 2,891,769; 3,092,188; 3,593,810; 2,686,660; and 3,424,256 evidence such operational limitations. Additional prior art includes U.S. Pat. Nos. 3,123,162; 3,145,785 and 3,894,590.

Drilling operations, particularly in petroleum exploration, are commonly carried out at great depths frequently reaching several thousands of feet below the earth's surface. Since a drill string is composed of a multiplicity of sections of drill pipe which must successively be disassembled upon removal from the borehole, the removal of the drill string from the borehole for the attachment of directional tools at the remote end of the drill string is an extremely time-consuming and thus expensive operation. Such procedures often entail several days of work. This "down time" is extremely expensive and a significant factor in the determination of the economic feasibility of exploratory drilling. The problem becomes chronic where, as is frequently the case, it is necessary to change the angle of borehole deviation several times requiring considerable "down time" in each instance.

In U.S. Pat. No. 3,974,886 a directional drilling tool is disclosed for accomplishing many of the aforementioned goals. However, while the directional drilling tool of the '886 patent does allow for remote actuation thereof, such is not capable of multiple repeated usages wherein the stabilizing pads are moved from radially inwardly to radially outwardly positions or intermediate positions, in any order, multiple times without requiring "down time" in removing the entire string because of the necessity of replacing shear pins and barrier rings associated with the movement of the stabilization pads thereof between the radially outwardly and radially inwardly positions. Specifically, the '886 reference does not permit movement of the stabilization pads to their respective outermost radial position and then at some later point usage thereof at an intermediate radial position without removal of the stabilization tool to replace such shear ring corresponding with the intermediate position, hence resulting in increased "down time."

Therefore, it has long been recognized that it would be desirable to have a directional drilling tool adapted for incorporation in a drill string individually or in any desired combination and capable of remaining inactive so as not to impede the normal drilling operations, but subject to being activated any number of times to any extent desired without requiring removal of the drill string from the borehole and which subsequently can be deactivated, reactivated, or reused without requiring removal thereof from the borehole.

SUMMARY OF THE INVENTION

It is an object of the present invention to provide a downhole stabilizing tool for directional drilling, with an actuator assembly therefor, and a method for using same to provide an improved directional drilling tool for drilling in the earth.

The downhole stabilizing tool of the present invention includes a tool housing communicating with the drill string, a sleeve assembly mounted within the tool housing for movement between selected positions and having camming members therewith for actuating stabilization pads mounted with the tool housing for radial movement thereof in response to movement of the sleeve assembly between the selected positions, pawl members with the tool housing for cooperating with the sleeve assembly for limiting movement of the sleeve assembly to the selected positions and pawl engaging members with the sleeve assembly for limiting movement of the sleeve assembly to the selected positions. The actuator assembly of the present invention includes a piston body member adapted to be positioned within the stabilizing tool and programming members with the piston body member a spaced apart programmed distance for cooperatively engaging surfaces of the stabilizing tool that are similarly spaced apart such a programmed distance for moving the stabilization pads to the preselected positions. The method of the present invention includes steps of pre-programming the actuator assembly prior to running the same into the drill string for selectively engaging the stabilizing tool to expand the stabilization pads radially outwardly as desired.

It should be understood that this description of the invention is not intended to be limiting but is only exemplary of the many patentable features of this invention, which are set forth in the claims.

DESCRIPTION OF THE PREFERRED EMBODIMENTS

Figure 1:
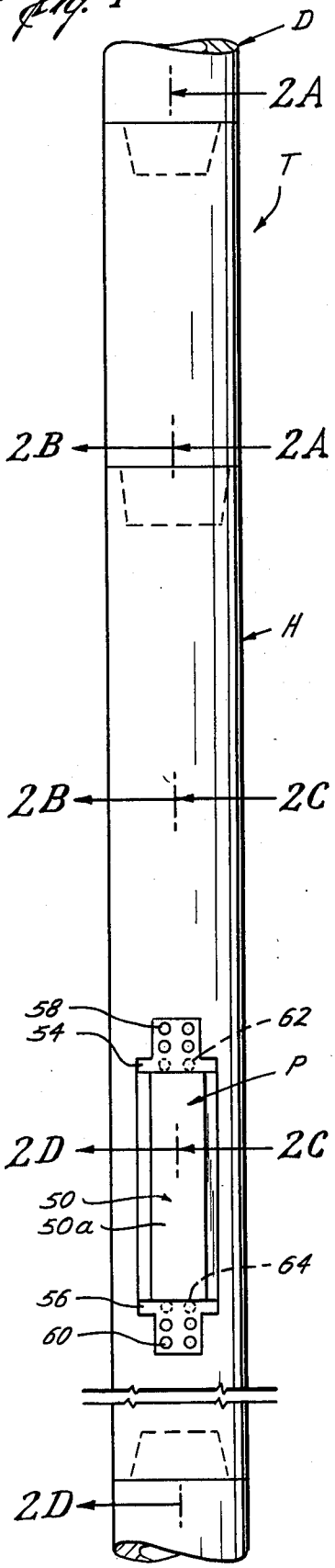
FIG. 1 is an elevational view of the downhole stabilizing tool of the present invention.

Referring to the drawings, the letter T designates generally the downhole stabilizing tool of the present invention. The downhole stabilizing tool T is adapted to be used for directional drilling and in conjunction with a fluid conductive drill string D in a borehole (not shown). Generally speaking, the downhole stabilizing tool T includes a tool housing H, a sleeve assembly S mounted for movement with the tool housing H, stabilization pad means P mounted with the tool housing H, pawl means M mounted with the tool housing H and adapted to cooperate with the sleeve assembly S for limiting movement thereof to selected positions, and pawl engaging means E for engaging the pawl means M for limiting movement of the sleeve assembly S to such selected positions. An actuator assembly A is adapted to be positioned within the downhole stabilizing tool T for programmed cooperation between the programming means G thereof and the stabilizing tool T for actuating the stabilizing tool T as desired. Unless otherwise noted, it is preferred that the components of this invention are made of steel or other suitable high strength components capable of taking the stresses and strains incumbent in drilling operations due to high torques, loads, pressures and various other significant stresses and strains.

Figure 2A:
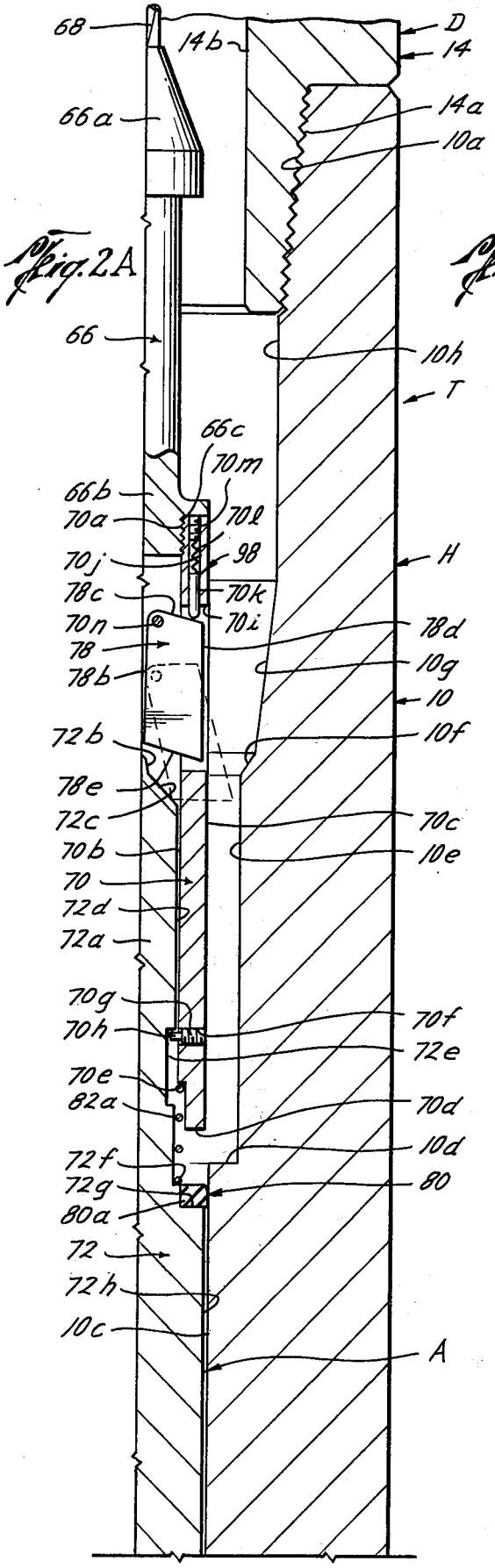
FIG. 2A is an elevational, sectional view of the upper portion of the stabilizing tool of the present invention as taken along the lines 2A—2A of FIG. 1 and illustrating the actuator assembly in a retracted position.
Figure 2B:
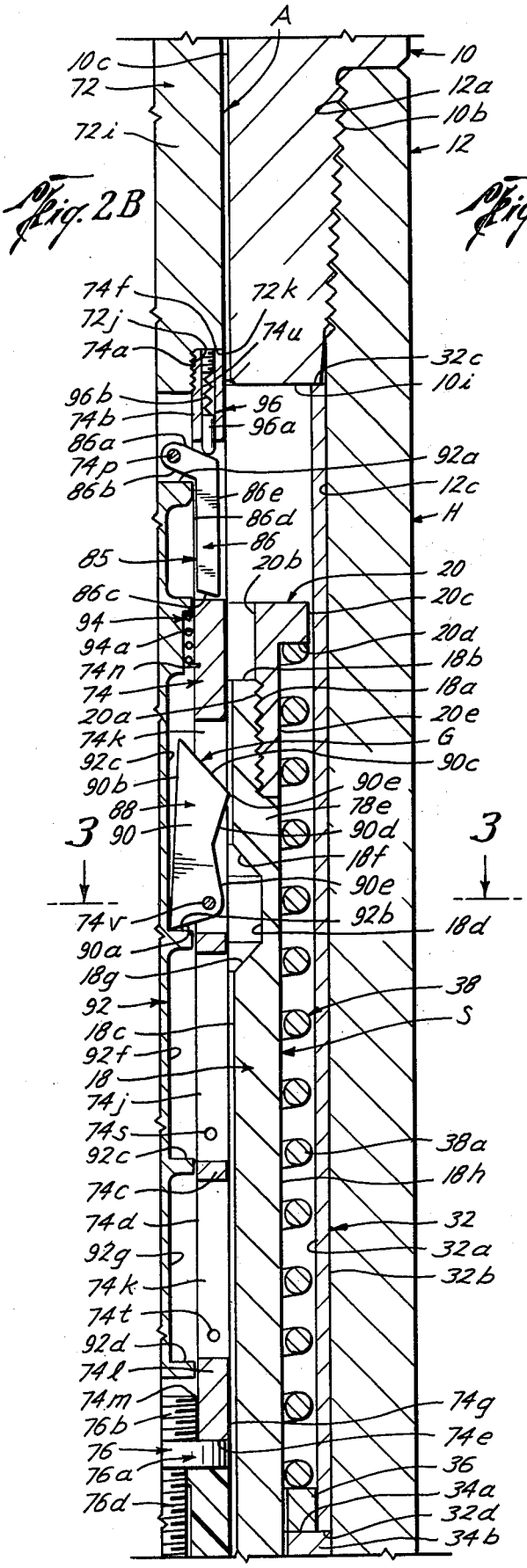
FIG. 2B is an elevational, sectional view of the stabilizing tool of the present invention as taken along the lines 2B—2B of FIG. 1, showing the programming means and upper stop means of the actuator assembly in a retracted position.
Figure 2C:
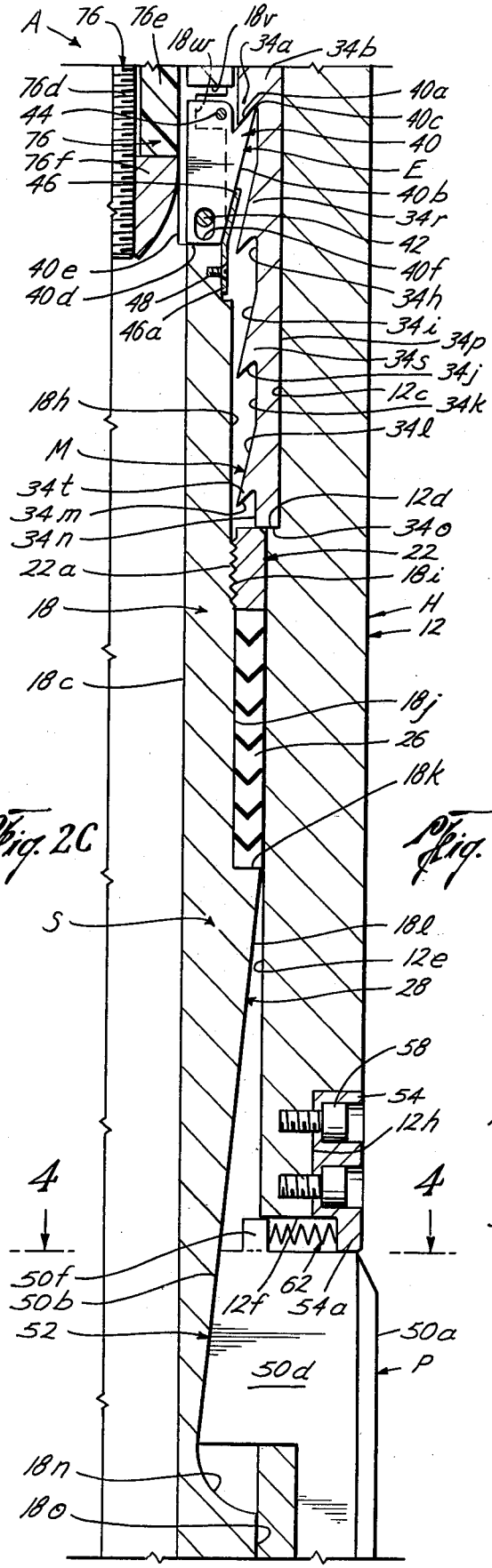
FIG. 2C is an elevational, sectional view of the stabilizing tool of the present invention as taken along the lines 2C—2C of FIG. 1 showing the pawl means and pawl engaging means in an initial position with a portion of the stabilization pad means illustrated in a retracted position.
Figure 2D:
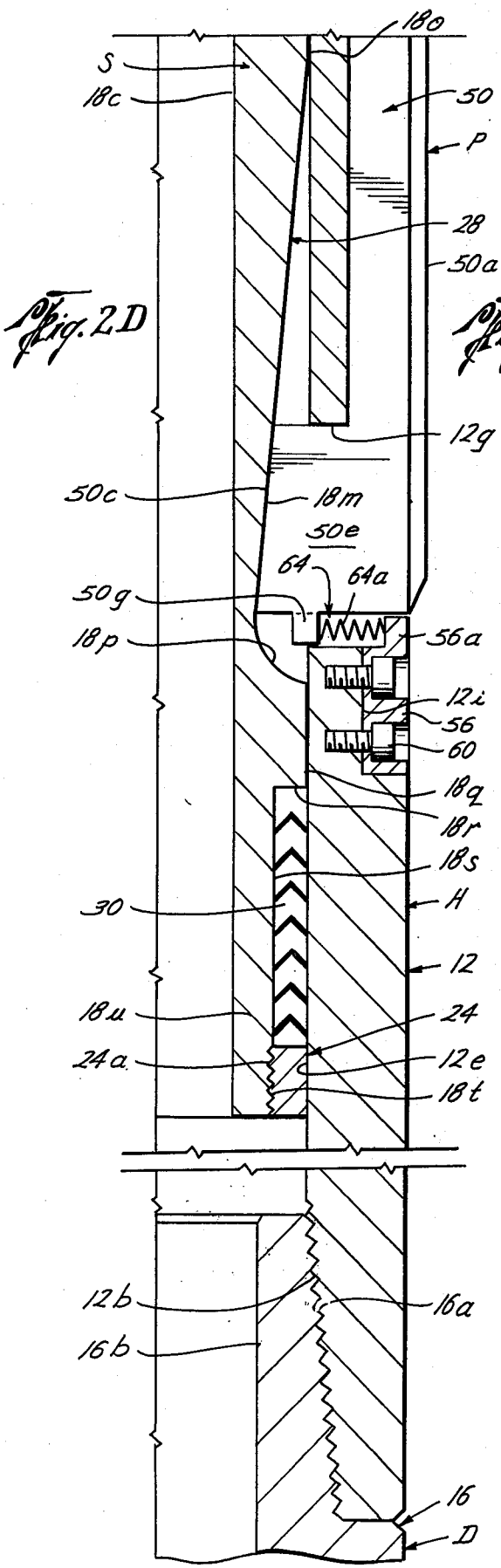
FIG. 2D is an elevational, sectional view of the stabilization tool of the present invention taken along the lines 2D—2D of FIG. 1 illustrating the stabilization pad means and camming means in a retracted position.

The downhole stabilizing tool T of the present invention includes tool housing H. The tool housing H includes upper housing 10 and lower housing 12. The upper housing 10 includes threads 10*a* which are adapted to engage compatibly formed threads 14*a* formed with the lower end of drill pipe 14 of the fluid conductive drill string D. The upper housing 10 further includes threads 10*b* formed adjacent the lower end thereof and adapted to engage upper threads 12*a* of lower housing 12. The lower housing 12 is threadedly affixed by lower threads 12*b* with threads 16*a* of drill pipe 16 (FIG. 2D). The drill pipe 14 may be affixed with numerous drill pipes (not shown), all of which comprise the fluid conductive drill string D while drill pipe 16 may be affixed with additional drill pipe or a conventional drill bit for boring a borehole within which the drill string D is located.

Preferably, the upper housing 10 is formed having a tool housing bore 10*c* therein and adapted to receive the actuator assembly A as discussed more fully hereinbelow. An annular lip 10*d* is formed between tool housing bore 10*c* and central opening 10*e* . Preferably, the central opening 10*e* is of the same diameter as the central openings 14*b*, 16*b* of the drill pipes 14, 16, respectively. Step portions 10*f*, 10*g*, and 10*h* are formed adjacent and between central opening 10*e* and threads 10*a* of the upper housing 10.

The tool housing H of the downhole stabilizing tool T further includes lower housing 12 having a bore 12*c* formed adjacent upper threads 12*a*, a radial lip 12*d* adjacent the lower portion of bore 12*c*, and bore 12*e* adjacent radial lip 12*d*. Preferably, a plurality of upper slots 12*f* and lower slots 12*g* are formed with the lower housing 12 adjacent bore 12*e* as described more fully hereinbelow. Detents 12*h*, 12*i* are formed adjacent slots 12*f*, 12*g*, respectively. Bore 12*e* extends downwardly through the lower housing 12 to lower threads 12*b*. Thus, the tool housing H is adapted to be connected with the fluid conductive drill string D and in fluid communication therewith.

The downhole stabilizing tool T of the present invention further includes a sleeve assembly S mounted for movement within the tool housing T between selected positions. The sleeve assembly S includes sleeve member 18, spring cap 20 and packing rings 22, 24. The sleeve member 18 includes upper threads 18*a* which are adapted to engage compatibly formed threads 20*a* of spring cap 20. End surface 18*b* is formed adjacent upper threads 18*a* with central bore 18*c* extending substantially the entire length of the sleeve member 18. An actuator detent 18*d* is preferably formed adjacent the upper end 18*e* of the sleeve member 18. Preferably, the actuator detent 18*d* includes tapered surfaces 18*f*, 18*g* adjacent such actuator detent 18*d* . Outer annular surface 18*h* is formed adjacent the upper end 18*e* and extends from the upper end 18*e* adjacent threads 18*a* downwardly to packing threads 18*i* which are adapted to threadedly engage threads 22*a* of packing ring 22. Packing surface 18*j* is formed adjacent packing threads 18*i* and is adapted to receive packing material 26 thereon. The packing material 26 may be of any suitable material as is desired. The packing material 26 is secured between the packing ring 22 and annular lip 18*k* formed adjacent packing surface 18*j* . The packing material 26 is adapted to be disposed between the sleeve member 18 and bore 12*e* of the lower housing 12 to ensure a fluid tight relation therebetween. An annular tapered camming surface 181 is formed adjacent annular lip 18*k* and extends downwardly therefrom in a substantially truncated conic section and forms a part of the camming means designated generally as 28 of the present invention. Annular tapered camming surface 18*m* is formed adjacent annular tapered surface 181 with annular lip 18*n* and outer surface 18*o* disposed therebetween. Annular lip 18*p* is formed adjacent the lower portion of outer surface 18*o* with outer surface 18*q* formed adjacent thereto. The annular tapered camming surface 18*m* also forms a portion of the camming means 28 of the present invention. An annular lip 18*r* is formed adjacent outer surface 18*q* with packing surface 18*s* and threads 18*t* formed adjacent thereto at the lower end 18*u* of the sleeve member 18. Packing material 30 of any suitable type is adapted to be mounted about packing surface 18*s* adjacent to annular lip 18*r* and secured in such position by packing ring 24 which has threads 24*a* for engaging threads 18*t* of the sleeve member 18 for securing the packing material 30 in its proper position. The packing material 30 is adapted to engage the bore 12*e* of the lower housing 12 for ensuring a fluid tight relation therebetween. A plurality of slots 18*v* (FIGS. 2C, 5C) are formed in the sleeve member 18 in selected circumferential positions for receiving the pawl engaging means E described more fully hereinbelow.

The spring cap 20 includes bore 20*b*, outside annular surface 20*c* and radial lip 20*d* with recess 20*e* formed adjacent to radial lip 20*d*, with the recess 20*e* of substantially the same diameter as outer annular surface 18*h* of sleeve member 18. Preferably, the outside annular surface 20*c* of spring cap 20 is of a lesser diameter than the inner annular surface 32*a* of sleeve 32, and as such may reciprocate therewithin. The sleeve 32 is adapted to be disposed within the bore 12*c* of lower housing 12, with the outer annular surface 32*b* of sleeve 32 in substantial engagement with bore 12*c* of lower housing 12 with the upper end surface 31*c* of sleeve 32 in engagement with end surface 10*i* of upper housing 10 and with the lower end surface 32*d* in an abutting relation with the upper end of the pawl means M described more fully hereinbelow.

The pawl means M includes pawl member 34 having an upper end surface 34*a* adjacent upper end 34*b* having interior surface 34*c* formed adjacent thereto, tapered surface 34*d*, inner surface 34*e*, tapered surfaces 34*f*, 34*g*, inner surface 34*h*, tapered surfaces 34*i*, 34*j*, inner surface 34*k*, tapered surfaces 32*l*, 34*m*, and inner surface 34*n* adjacent end surface 34*o* which is adapted to abut radial lip 12*d* of lower housing 12. It should be noted that the interior surface 34*c* is of a smaller diameter than the diameter of the inner section of tapered surfaces 34*f*, 34*g*, or 34*i*, 34*j*, or 34*l*, 34*m*, as discussed more fully hereinbelow. The outer annular surface 34*p* of the pawl member 34 is adapted to engage bore 12*c* of lower housing 12 much as outer annular surface 32*b* of sleeve 32 engages such bore 12*c*.

It should be noted that the surfaces 34*c*, 34*d*, 34*e* form a first pawl 34*q*, surfaces 34*f*, 34*g*, 34*h* form a second pawl 34*r*, surfaces 34*i*, 34*j*, 34*k* form third pawl 34*s*, and surfaces 34*l*, 34*m*, 34*n* form a fourth pawl 34*t* of the pawl member 34 as described more fully hereinbelow. Preferably, four of such pawl members 34 are disposed circumferentially about the bore 12*c* of the lower housing 12 of the tool housing H.

Threaded engagement of the upper housing 10 with the lower housing 12 ensures that the end surface 10*i* secures the sleeve 32 in position within the bore 12*c* of lower housing 12 with the lower end surface 32*d* of sleeve 32 abutting upper end surface 34*a* of pawl member 34 and lower end surface 34*o* abutting radial lip 12*d* of the lower housing 12 for securing the sleeve 32 and pawl member 34 with tool housing H. A spring retainer 36 is mounted in an abutting relation with the upper end surface 34*a* of pawl member 34 and within the inner annular surface 32*a* of sleeve 32 adjacent thereto and adapted to receive resilient sleeve means designated generally as 38 therein. Preferably, the resilient sleeve means 38 includes a suitable coil spring 38*a* adapted to be mounted at the lower end thereof with spring retainer 36 and in abutting relation with radial lip 20*d* of spring cap 20 adjacent the upper end thereof. As such, the resilient sleeve means 38 provides an upward urging or biasing of the spring cap 20 and sleeve member 18 of the sleeve assembly S.

Figure 5A:
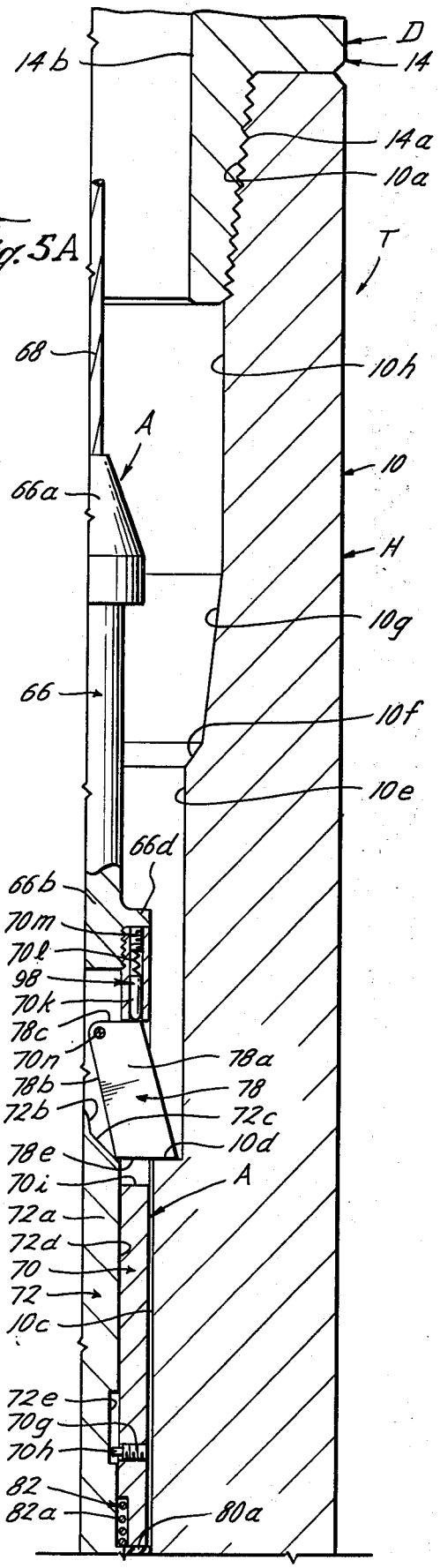
FIG. 5A is a sectional, elevational view of the stabilizing tool of the present invention, similar to FIG. 2A with the upper stop means in its expanded position.
Figure 5B:
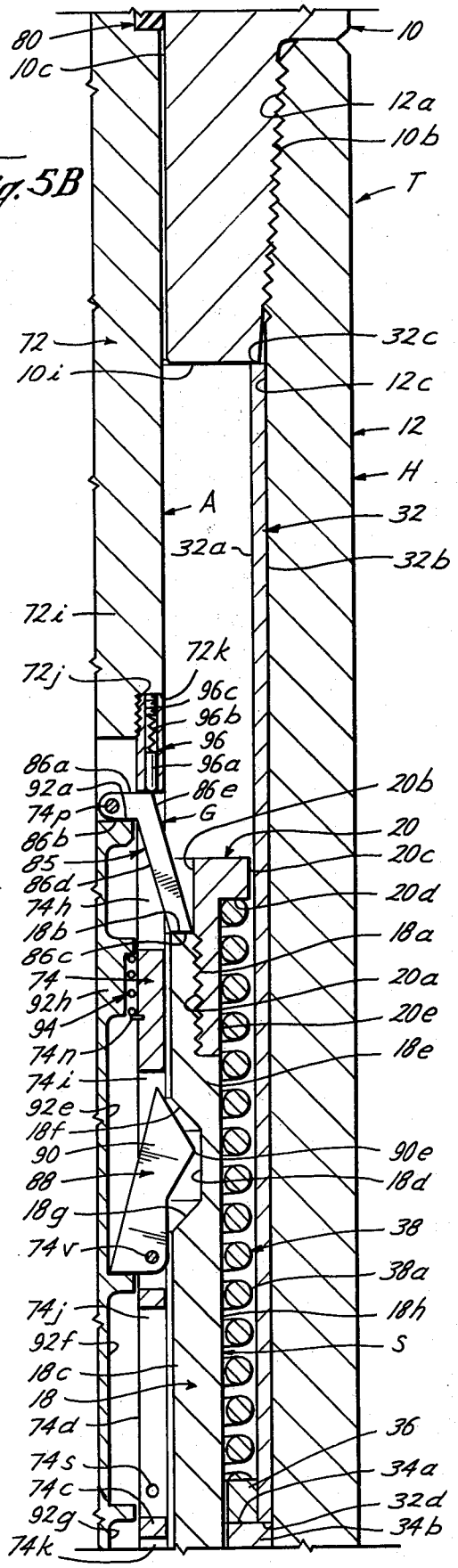
FIG. 5B is an elevational sectional view of the stabilizing tool of the present invention, similar to FIG. 2B except showing the programming means of the actuator assembly fully engaging the sleeve assembly of the stabilizing tool for actuating the same.
Figure 5C:
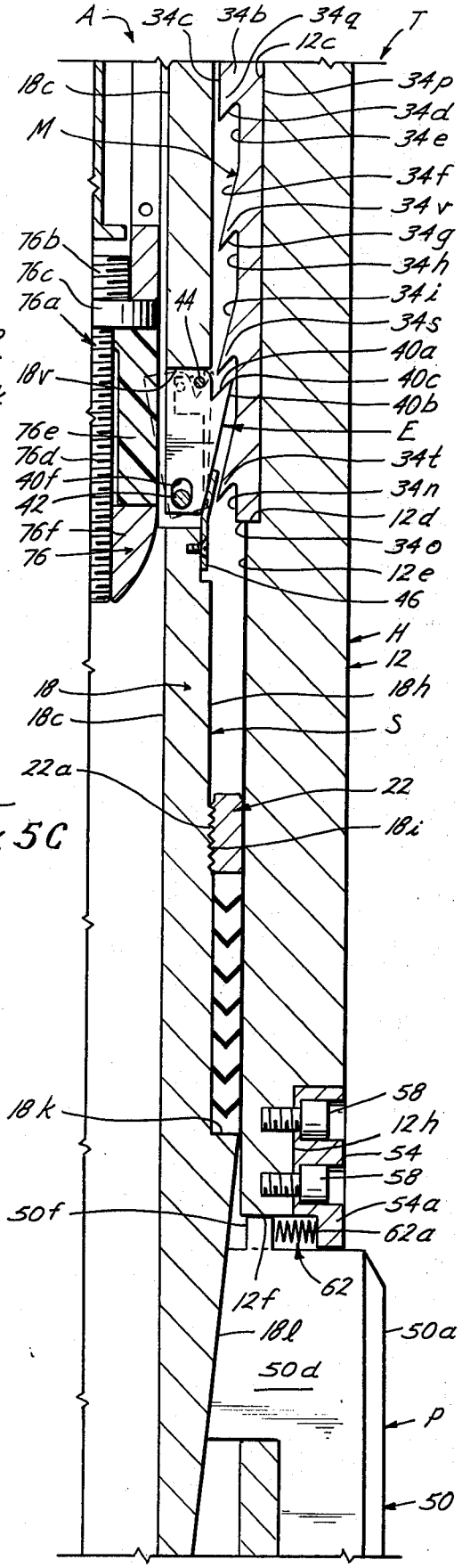
FIG. 5C is an elevational, sectional view of the stabilizing tool of the present invention, similar FIG. 2C, however showing the pawl means and pawl engaging means positioned for lateral movement of the stabilization pad means.

The downhole stabilizing tool T of the present invention further includes pawl engaging means E with the sleeve assembly S for engaging the pawl means M for limiting movement of the sleeve assembly S to selected positions. The pawl engaging means E includes at least one spring dog 40 movably mounted with the sleeve assembly S. The spring dog 40 (FIGS. 2C, 5C) is formed having tapered surfaces 40*a*, 40*b* adjoining at edge 40*c*, lower end surface 40*d* adjacent tapered surface 40*b*, inner surface 40*e* and slot 40*f*. Pin 42 mounted with the sleeve member 18 is adapted to be received in slot 40*f* to allow pivotal movement of the spring dog 40 about the pin 42 while pin 44 is mounted with the spring dog 40 for limiting the amount of radially inward pivoting of the spring dog 40 about the pin 42 when the pin 44 engages detent surface 18*w* formed with slots 18*b* as described more fully hereinbelow. As shown in FIG. 5C, the spring dog 40 is movable between a substantially vertical position shown in solid lines to that of a radially inwardly position as shown by the dotted lines as discussed more fully hereinbelow. Preferably, a suitable bias means designated generally as 46 includes leaf spring 46*a* affixed with the sleeve member 18 by suitable fastener 48 and appropriately affixed with the tapered surface 40*b* of spring dog 40 for providing a continuous radially inwardly urging or biasing of the spring dog 40. Preferably, the number of spring dogs 40 used in the stabilizing tool T of the present invention corresponds to the number of pawl members 40 utilized.

Figure 4:
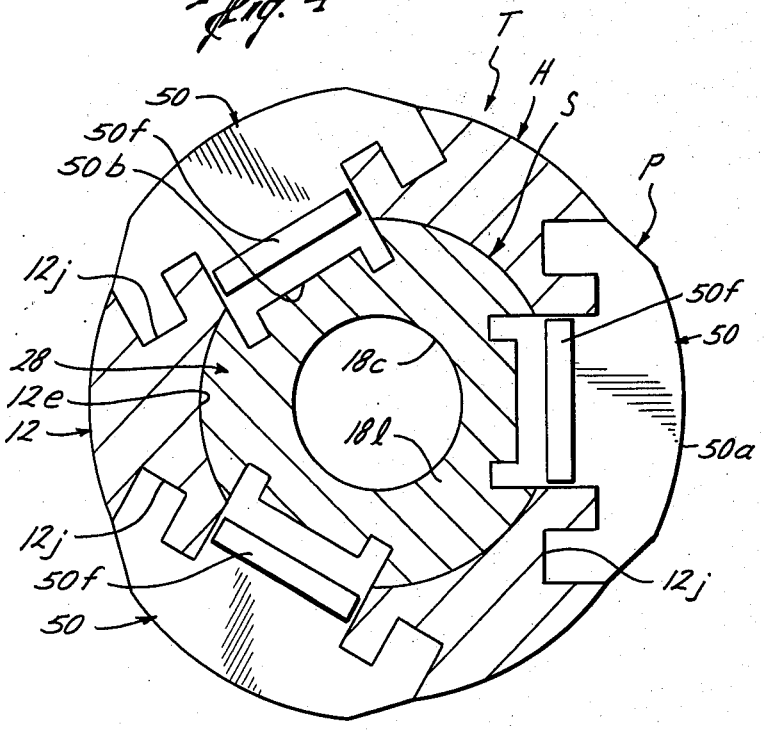
FIG. 4 is a sectional plan view of the stabilization pad means of the downhole stabilizing tool of present invention taken along the lines 4—4 of FIG. 2C.
Figure 5D:
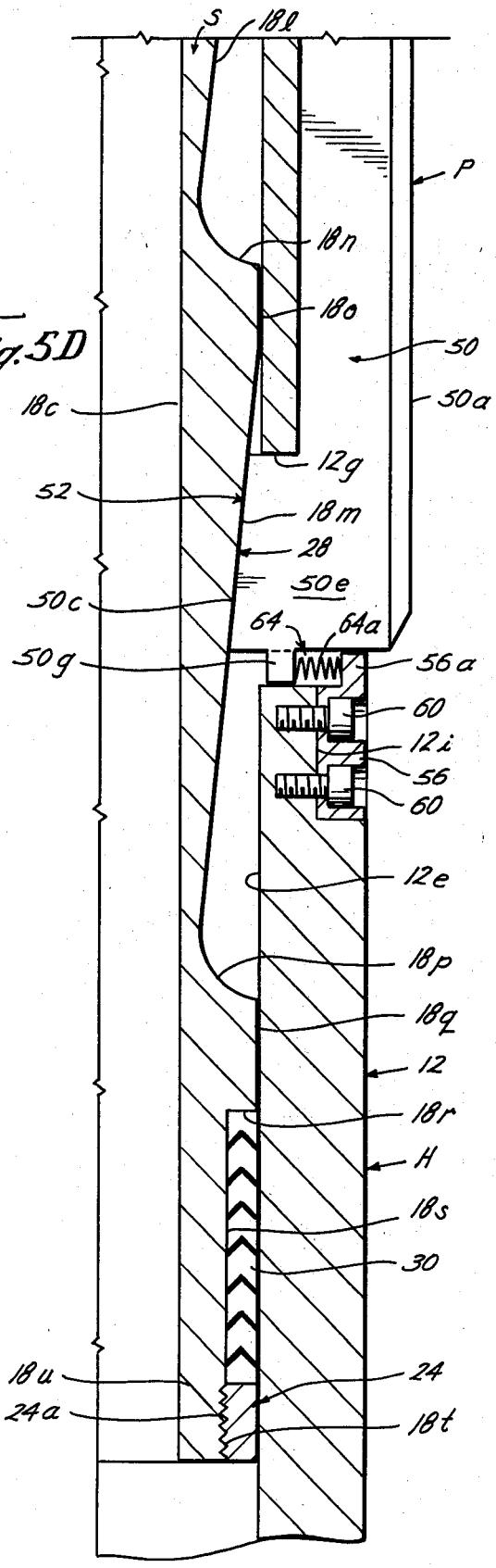
FIG. 5D is a sectional, elevational view of the stabilizing tool of the present invention similar to FIG. 2D, however showing the stabilizing pad means in an expanded lateral position.

The downhole stabilizing tool T of the present invention further includes stabilization pad means P mounted with the tool housing H for selective movement laterally of the tool housing H for selected engagement with the borehole as desired. The stabilization pad means P includes pressure plates 50 which are adapted to be mounted within slots 12*f*, 12*g* formed in the lower housing 12. The pressure plates 50 are mounted with the lower housing 12 for slidable movement along radially extending paths extending from the tool housing H, between the retracted positions shown in FIGS. 2C, 2D and the extended positions shown in FIGS. 5C, 5D. Each pressure plate 50 has an exterior wear surface 50 *a* of suitable design and an internal cam surface 50*b* for engaging annular tapered camming surface 181 of the sleeve member 18 which comprises a portion of the camming means 28 (FIGS. 2C, 4, 5C). Similarly, internal cam surface 50*c* engages annular tapered camming surface 18*m* of the sleeve member 18. The internal surfaces 50*b*, 50*c* form the cam engaging means designated generally as 52 of the present invention. The pressure plate 50 is formed having an upper arm 50*d* which is receivable within slot 12*f* and a lower arm 50*e* receivable within slot 12*g*. Upper tab 50*f* is formed adjacent upper arm 50*d* and lower tab 50*g* is formed adjacent lower arm 50*e*. It will be appreciated that downward movement of the tapered camming surfaces 181, 18*m* of the sleeve member 18 in cooperative engagement with tapered cam surfaces 50*b*, 50*c* of pressure plate 50 results in radially outwardly, lateral movement of the pressure plates 50 of the stabilization pad means P of the present invention. As best seen in FIG. 4, the pressure plates 50 are received within a suitably formed receptacle 12*j* formed in the lower housing 12 for radially outwardly movement thereof. The pressure plates 50 are retained with the lower housing 12 by means of lock plates 54, 56 mounted in detents 12*h*, 12*i*, respectively and secured therewith the lower housing by appropriate fasteners 58, 60, respectively. Tabs 54*a*, 56*a* of lock plates 54, 56 act to secure suitable resilient members 62, 64, including springs 62*a*, 64*a* therebetween such tabs 54*a*, 56*a* and tabs 50*f*, 50*g*, respectively. The resilient members 62, 64 may include suitable springs such as springs 62*a*, 64*a* which act to resiliently urge the pressure plate 50 of the stabilization pad means P into engageable contact with the camming means 28 of the present invention. It is preferred that plural resilient members 62, 64 be provided as best seen in FIG. 1 for uniform expansion and resilient urging upon the stabilization pad means P of the present invention. Thus, the pressure plates 50 are retained in position by the lock plates 54, 56 and resilient members 62, 64 urging the pressure plates 50 into engagement with the camming means 28 of the present invention.

The present invention further includes an actuator assembly A for actuating the stabilizing tool T to move the stabilization pad means P to preselected positions by programmed, cooperative engagement therebetween the programming means G of the actuator assembly A and compatibly formed surface of the stabilizing tool T as discussed more fully hereinbelow. The actuator assembly A includes a wireline connector 66 adapted to be connected to a suitable wireline 68, a stop body member 70, spacer means designated generally as 72, piston body member 74 and pawl resiliency means designated generally as 76.

The actuator assembly A of the present invention includes wireline connector 66 which is mounted with wireline 68 adjacent upper end 66*a* thereof and is threadedly connected by threads 66*b* adjacent the lower end 66*c* thereof to compatible threads 70*a* formed with stop body member 70. The stop body member 70 is preferably of a cylindrical design having bore 70*b* extending therethrough, an outer annular surface 70*c*, a lower end surface 70*d* with a detent 70*e* formed adjacent thereto, and opening 70*f* formed adjacent the lower end surface 70*d* and is adapted to threadedly receive stop plug 70*g* therein. The stop plug 70*g* includes stop tab 70*h* formed therewith. Preferably, radial slots such as slot 70*i* are formed with the stop member 70 and preferably include four such slots 70*i* which are disposed circumferentially equidistance about the stop body member 70. Preferably, longitudinal openings 70*j* are formed adjacent such slots. Pins 70*k* are disposed in slots 70*i* for movement within the longitudinal opening 70*j*. A spring 70*l* urges the pin 70*k* downwardly and a suitably threaded plug 70*m* secures the spring 70*l* and pin 70*k* with the stop body member 70. Tab 66*d* of the wireline connector 66 further secures the plug 70*n* in position when the wireline connector 66 is in threaded engagement with the stop body member 70.

Upper stop means designated generally as 78 is mounted with the stop body member 70 by means of pivot pin 70*n*. The upper stop means 78 includes upper stop 78*a* formed having surfaces 78*b*, 78*c*, 78*d*, 78*e* about the perimeter thereof. The upper stop means 78 is adapted to pivot about pivot pin 70*n* between a first position wherein the upper stop means 78 is in a retracted, radially inwardly position with respect to the stop body member 70 as shown in FIG. 2A to that of a second position wherein the upper stop means 78 is in an expanded, radially outwardly position as shown in dotted lines in FIG. 2A or as illustrated in FIG. 5A, as discussed more fully hereinbelow.

Spacer means 72 is adapted to be received within the bore 70*b* of the stop body member 70. More particularly the spacer means 72 includes an upper end 72*a* adapted to be received within the bore 70*b* of stop body member 70. The upper end 72*a* is formed having a pointed end 72*b* and conic tapered surface 72*c* adjacent outer annular surface 72*d* of the upper end 72*a* of the spacer means 72. A suitable detent 72*e* is formed in the outer annular surface 72*d* with radial lips 72*f*, 72*g* formed adjacent thereto, and an annular surface 72*h* is formed adjacent radial lip 72*g*. Preferably, the diameter of the annular surface 72*h* is such that the annular surface 72*h* of spacer means 72 is adapted to be disposed within tool housing bore 10*c* of upper housing 10 and with appropriate seal means 80 disposed between the tool housing bore 10*c* adjacent radial lip 72*g* for ensuring a fluid tight relation between the spacer means 72 and upper housing 10 of the tool housing T of the present invention as desired. The seal means 80 may include any type of suitable seal 80*a* to ensure the fluid tight relation therebetween.

Resilient upper stop means designated generally as 82 is used for biasing the stop body member 70 in the first position with the upper stop means 78 being retracted. The resilient upper stop means 82 includes a suitable spring 82*a* adapted to be mounted adjacent and with radial lip 72*f* adjacent surface 72*d* and extending thereto detent 70*e* formed with the stop body member 70. The stop tab 70*h* of the stop plug 70*g* is adapted to be received within the detent 72*e* formed in the spacer means 72. Relative reciprocal movement between the stop body member 70 and spacer means 72 is limited to the extent of the detent 72*e* and the travel of the stop tab 70*h* therein, with the resilient upper stop means 82 biasing the stop body member 70 in the first position wherein the upper stop means 78 is retracted.

Figure 3:
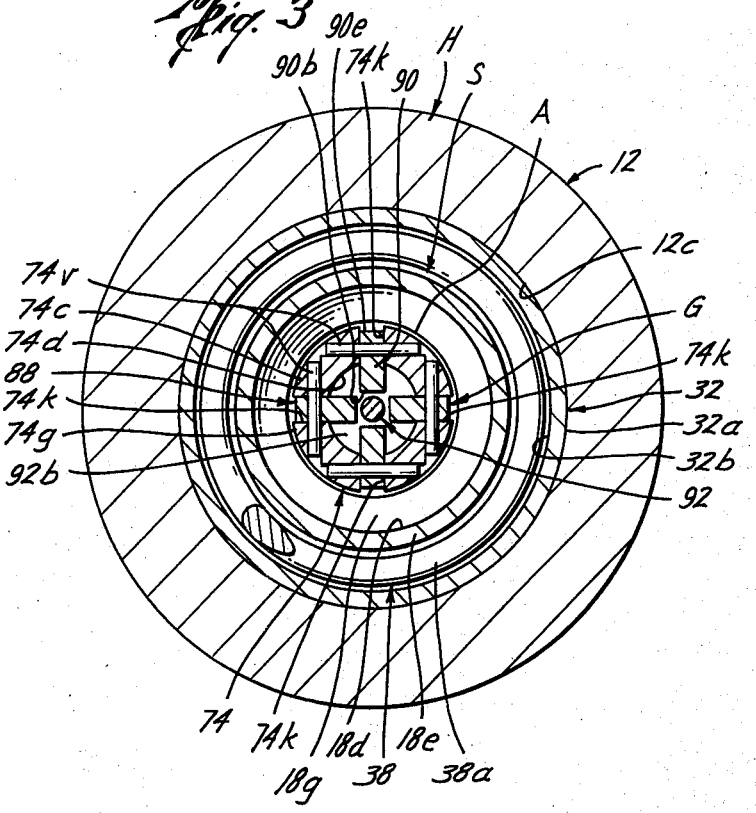
FIG. 3 is a sectional plan view of the stabilization tool of the present invention taken along the lines 3—3 of FIG. 2B.

The spacer means 72 further includes a lower end 72*i* which has treads 72*j* formed adjacent thereto and radial lip 72*k* adjacent threads 72*j*. The threads 72*j* of spacer means 72 are adapted to threadedly engage threads 74*a* formed with the upper portion 74*b* of the piston body member 74. The piston body member 74 includes a cylindrical sleeve 74*c* having a bore 74*d* formed therein. The sleeve 74*c* includes end surfaces 74*e*, 74*f*, and outer annular surface 74*g*. Preferably, a plurality of circumferentially disposed radially extending lower stop slots 74*h* are formed with the sleeve 74*c* as are a plurality of circumferentially disposed radially extending first latch slots 74*i*, second latch slots 74*j*, and third latch slots 74*k*. As best seen in FIG. 3, preferably slots 74*h*, 74*j*, 74*k* are formed as first latch slot 74*i* and preferably include four of such slots circumferentially disposed equidistance about the piston body member 74. Adjacent the lower portion 74*l* suitable threads 74*m* are formed for receiving pawl resiliency means designated generally as 76 discussed more fully hereinbelow. The sleeve 74*c* further includes suitable detent (not numbered) for receiving a snap ring 74*n* therein.

The lower stop means designated generally as 85 and the latch means designated generally as 88 are mounted with the piston body member 74. The lower stop means 85 includes lower stop 86 that is pivotally mounted with the piston body member 74 by pin 74*p* to allow movement thereof between an initial position wherein the lower stop means 86 is in a radially inwardly position as shown in FIG. 2B and a final position wherein the lower stop means 86 is in a radially outwardly position as shown in FIG. 5B. The lower stop 86 includes surfaces 86a, 86b, 86c which are preferably parallel with one another and inner and outer surfaces 86d, 86e, respectively. Similarly, latch means 88 is mounted with the piston body member 74 by means of pin 74v to allow pivotal movement of the latch means 88 from a primary position wherein the latch means 88 is in a contracted, radially inwardly position as shown in FIG. 2B and a secondary position wherein the latch means 88 is in an expanded, radially outwardly position as shown in FIG. 5B. Preferably, the latch means 88 includes latch dog 90 having surfaces 90a, 90b, 90c, 90d, 90e. Latch dogs such as latch dog 90 are adapted to be disposed within either the first latch slots 74k of the piston bocy member 74 merely by repositioning of pin 74r within the openings 74s in second latch slot 74j and latch means 88 or opening 74t in third latch slots 74k and latch means 88.

A piston assembly 92 is adapted to be disposed within the piston body member 74. The piston assembly 92 includes a lower stop engaging surface 92a, first latch dog engaging surface 92b, second latch dog engaging surface 92c, and third latch dog engaging surface 92d. A first latch dog recess 92e is formed adjacent engaging surface 92b, a second latch dog recess 92f is formed adjacent engaging surface 92c and a third latch dog recess 92g is formed adjacent engaging surface 92d. A spring portion 92h is formed above recess 92e and is adapted to receive bias means 94 which includes spring 94a with the piston body member for biasing the piston assembly 92 for movement from a lower position wherein the piston assembly is in the position shown in FIG. 2B to an upper position wherein the piston assembly 92 is in the position illustrated in FIG. 5B. The bias means 94 is adapted to be positioned between the snap ring 74n of the piston body member 74 and the spring portion 92h of the piston assembly 92 with a constant upward urging upon the piston assembly 92 by the spring 94a. As such, the piston assembly 92 is adapted to move reciprocally within the bore 74d of the piston body member 74.

The pawl resiliency means 76 is adapted to be mounted with the lower portion 741 of the piston body member 74. The pawl resiliency means 76 includes mounting member 76a which includes threads 76b which are adapted to engage compatibly formed threads 74m of the piston body member 74 for attachment therewith. The mounting member 76a has a central portion 76c which is adapted to abut end surface 74e when in threaded engagement with the piston body member 74. A threaded shaft 76d preferably extends downwardly from the central portion 76c and is adapted to receive resilient material portion 76e thereabout having a securing cap 76f adjacent the lower portion thereof and in threaded engagement with threaded shaft 76d. Preferably, the resilient material portion 76e may be of any suitable resilient material such as polyurethane or the like as discussed more fully hereinbelow while the securing cap 76f is preferably of an appropriate high strength material. Unthreading of the securing cap 76f allows removal of the resilient material portion 76e from the threaded shaft 76d of the pawl resiliency means 76.

Lower stop resiliency means designated generally as 96 is formed with the upper portion 74b of the piston body member 74 and includes a pin 96a adapted to be movably mounted within a suitable opening 74u formed in piston body member 74, a spring 96b mounted in the opening 74u, and a threaded plug 96c adapted to be threaded into a portion of the opening 74u such that the spring 96b acts against plug 96c to force pin 96a downwardly into engagement with the lower stop means 85.

In the use or operation of the downhole stabilizing tool T and actuator assembly A of the present invention, the tool housing H necessarily must be affixed with the drill string D. However, prior to such affixation, the stabilizing tool T must be preprogrammed. As noted hereinabove, the actuator assembly A includes programming means G for cooperatively engaging surfaces formed with the stabilizing tool T that are a spaced apart programmed distance for moving the stabilization pad means P between contracted and expanded lateral positions. Preprogramming of the stabilizing tool T is accomplished by establishing a specific distance between end surface 18b and actuator detent 18d of the sleeve member 18. This distance must correspond between the distance between the latch dog 90 and surface 86c of lower stop 86 which forms the programming means G of the present invention as is discussed more fully hereinbelow. Thereafter, the stabilizing tool T of the present invention is mounted with the fluid conductive drill string D and lowered into the borehole. Multiple downhole stabilizing tools T may be mounted with the drill string D as it is lowered into the borehole and may include up to three of such stabilizing tools T being used based upon the embodiments shown in the figures. However, appropriate modification of the stabilizing tool T and actuator assembly A may be made to accommodate a greater number of stabilizing tools T in one drill string D as may be necessary.

As the drill string D is lowered into the borehole, typically drilling mud is forced through the central opening 14b of the drill pipe 14, through the bore of the downhole stabilizing tool T to the drill bit (not shown) for drilling operations. When it is desired to actuate the stabilizing tool T, the fluid pressure is removed from the drill string D. The actuator assembly A is preprogrammed with the programming means G to correspond with the predetermined distance such that the distance between surface 86c of the lower stop 86 and latch dog 90 correspond to that of the predetermined distance between end surface 18b and actuator detent 18d of sleeve member 18. As such, the actuator assembly A is then lowered into the drill string D by means of wireline 68. During the lowering operation, the upper stop resiliency means designated generally as 98 and including pin 70k, spring 70l, and plug 70m act to keep the upper stop means 78 in a retracted position because of the urging of pin 70k upon a surface 78c of the upper stop 78a, with the upper stop 78a pivoting about pin 70n to remain in a retracted position. Accordingly, the upper stop 78a will not catch or snag upon any surface or lip during lowering of the wireline 68. Similarly, the lower stop means 85 is maintained in the initial position shown in FIG. 2B by means of lower stop resiliency means 96. The lower stop resiliency means 96 urges the lower stop means 85 into the initial position by the pin 96a acting upon surface 86a with the lower stop 86 pivoting about pin 74p to a radially inward position. Accordingly, the lower stop means 85 will similarly not snag or catch upon any lateral surfaces. On the other hand, latch means 88 which includes latch dog 90 is free to move between its primary and secondary positions based upon any contact that it may have with any surface or edge during its travels while the actuator assembly A is being lowered on the wireline 68.

As the actuator assembly A is lowered, the edge 90e of the latch dog 90 between surfaces 90c, 90d is adapted to ride upon any inner surface encountered. As the inner surface expands, the latch dog 88 pivots outwardly in response to the upward urging of the bias means 94 upon piston assembly 92 such that the piston assembly 92 tends to force the latch dog 90 outwardly. As the latch dog 90 moves outwardly, the piston assembly may move reciprocally within the sleeve assembly S such that the lower stop engaging surface 92*a* comes in contact with surface 86*b* of the lower stop 86 and forces the lower stop 86 outwardly against the action of the lower stop resiliency means 96. However, for any movement of the lower stop 86 to occur, such must be positioned in the area where the lower stop 86 may radially expand. For example, if the latch dog 90 had just been lowered below end surface 10*i* (FIGS. 2B, 5B) with the latch dog 90 expanding radially outwardly, the piston assembly 92 would be urged upwardly by the bias means 94 resulting in action of lower stop engaging surface 92*a* against surface 86*b* of the lower stop 86. However, the surface 86 *e* of the lower stop 86 would engage the bore 10*c* of the upper housing 10 and consequently would be unable to radially expand. The latch dog 90 is configured in such a fashion so that it is easily received in and out from any surface and/or detent which is accomplished by tapered surfaces 90*c*, 90*d*, 90*e* which guide the latch dog 90 in and out of potential hindrances as nat be encountered during lowering of the actuator assembly A.

When the latch dog 90 engages the actuator detent 18*d* of the sleeve member 18, as before, the latch dog 90 may move radially outwardly from the primary position to its secondary position shown in FIG. 5B, in response to urging of the bias means 94 on piston assembly 92. As a consequence, the surface 90*a* of the latch dog 90 engages first latch dog engaging surface 92*b* of the piston assembly 92 while at the same time, lower stop engaging surface 92*a* comes in full face contact with surface 86*b* of the lower stop 86, forcing the lower stop means 85 radially outwardly from its initial position (FIG. 2B) to the final position shown in FIG. 5B, against the action of the lower stop resiliency means 96. As a consequence, surface 86*a* of the lower stop 86 contacts and abuts the upper surface of slot 74*h* allowing surface 86*c* of the lower stop 86 to come into full face engagement with end surface 18*b* of sleeve member 18.

When the actuator assembly A is lowered into this position, the seal means 80 comes into engagement with the bore 10*c* of upper housing 10. With the lower stop means 85 in engagement with end surface 18*b* of the sleeve member 18, resistance to additional lowering thereof is encountered at the surface of the well. Thereafter, the fluid pressure is reexerted upon the drill string D and the stabilizing tool T and actuator assembly A of the present invention. As a result of the sealable relation between the spacer means 72 and upper housing 10 by seal means 80, pressure begins to act upon the combination of the wireline connector 66 and stop body member 70. As pressure increases, the stop body member 70 is forced downwardly from its first position wherein the upper stop means 78 is in a retracted (FIG. 2A) position to a second position where the upper stop means 78 is in the expanded position (FIG. 5A). As the pressure continues to increase, the stop body member 70 is forced downwardly with respect to the upper end 72*a* of the spacer means 72 until the upper stop 78*a* engages first the point 72*b* then surface 72*c* of the spacer means 72 resulting in outward movement thereof, against the action of the upper stop resiliency means 98. Thus, the upper stop means 78 moves from the position shown in solid lines in FIG. 2A to that of the dotted lines as the stop body member 70 moves downwardly in response to increased fluid pressure. It should be noted that the increased fluid pressure allows overcoming of the spring 82*a* of the resilient upper stop means 82 with the stop tab 70*h* limiting the extent to which the stop body member 70 may be moved downwardly, as does lower end surface 70*d* when such engages the seal 80*a* for compression thereof to ensure a fluid tight relation therebetween the spacer means 72 and upper housing 10 of the tool housing H. Further, increased fluid pressure results in action of the lower stop means 85 against the sleeve assembly S such that the sleeve assembly S is forced downwardly against action of the resilient sleeve means 38. The forcing downwardly of the sleeve member 18 results in downward movement of the camming means 28 with respect to the stabilization pad means P. Such downward movement of the camming surfaces 181, 18*m* with respect to the similarly formed cam surfaces 50*b*, 50 *c* of the pressure plates 50, result in radially outward expansion of the stabilization pad means P. As the sleeve member 18 is forced downwardly in response to fluid pressure, the pawl engaging means E engages the pawl means M such that as the tapered surface 40*a* of the spring dog 40 loses contact with surface 34*d* of the pawl member 34 and the spring dog 40 is urged radially inwardly by resilient member 46. However, such radial inward movement is limited by the spring dog 40 contacting the resilient material 76*e* of the pawl resiliency means 76. As the tapered surface 40*b* engages tapered surface 34*f*, the spring dog 40 is forced radially inwardly into the resilient material 76*e* such that edge 40*c* clears the point of pawl 34*r* and is positioned adjacent surface 34*h*. Thus, the resilient material 76*e* is of sufficient resiliency to prevent radially inward movement of the spring dog 40 because of its resilient nature yet will flex a sufficient amount to allow the tip 40*c* of the spring dog 40 to clear the corresponding tip of the pawls such as pawl 34*r* as the sleeve member 18 moves downwardly. As such, the spring dog 40 pivots about pin 42 with pin 44 limiting the maximum extent to which the spring dog 40 may move radially inwardly into the resilient material 76*e*. Sizing of the spacer means 72 permits selective engagement with pawls 34*r*, 34*s*, 34*t*. The upper stop means 78 engagement of surface 78*e* with annular lip 10*d* limits the extent to which the sleeve assembly S may move downwardly. Accordingly, either the distance between surfaces 78*e* of the upper stop means 78 and 86*c* of the lower stop 86 and/or the distance between annular lip 10*d* of the upper housing 10 and end surface 18*b* of the sleeve member is determinative of the extent to which the sleeve assembly S of the present invention may move within the stabilizing tool T. As is illustrated in the FIGS., this distance permits movement of the spring dog 40 beyond pawl 34*r* into engagement with pawl 34*s* but prevents engagement with pawl 34*t*. If the distance between the upper stop means 78 and lower stop means 85 were greater, then the spring dog 40 could move lower into engagement with pawl 34*t*, however, such is not the case. As the spring dog 40 clears pawls 34*r*, 34*s*, each time the spring dog 40 is forced into the resilient material 76*e* which springs the spring dog 40 radially outwardly after the point of the pawl is passed against the action of the resilient member 46. Positioning the spring dog 40 adjacent respective pawls 34*r*, 34*s*, 34*t* correspondingly relates to specific radial, lateral positions of the stabilization pad means P with respect to the tool housing H.

When the spring dog 40 is positioned adjacent the proper pawl, such as pawl 34*s* in FIG. 5C, the fluid pressure is released, causing the stop body member 70 to move upwardly in response to the upward urging of the resilient upper stop means 82, which in turn prevents engagement of the upper stop 78*a* with the surfaces 72*c* and point 72*b* of the spacer means 72, causing retraction of the upper stop means 78 from its radially expanded position to the radially inwardly position. The upper stop resiliency means 98 ensures that the upper stop means 78 is fully retracted. Furthermore, upward movement of the stop body member 70 is sufficient to allow clearance of the annular lip 10*d* by the surface 78*e* of the upper stop means 78 once pressure on the drill string D has been removed. At this point, the wireline 68 retracted thus resulting in upward movement of the actuator assembly A. Such upward movement results in action between tapered surface 18*f* adjacent actuator detent 18*d* in sleeve member 18 with surface 90*c* of the latch dog 90, causing pivotal rotation about pin 74*r* with surface 90*a* no longer in full face contact with first latch dog engaging surface 92*b*, with such action forcing the piston assembly 92 downwardly against action of the bias means 94 resulting in a lack of full face engagement between surface 86*b* of lower stop means 85 and lower stop engaging surface 92*a* of piston assembly 92, thus allowing the lower stop resiliency means 96 to act upon the lower stop means 85 for moving the same from the final position back to its initial position.

In any areas where no constraining bore force either the latch dog 90 or lower stop means 85 into their primary and initial positions, respectively, such as in the area between end surface 10*i* of upper housing 10 and above spring cap 20, surface 86*e* would contact the end surface 10*i* thus forcing the lower stop means 85 inwardly to move the piston assembly 92 downwardly allowing radially inward movement of the lower stop means 85. As such, the actuator assembly A of the present invention may be retracted from the borehole with the stabilizing tool T being used as necessary.

Should it be desired that the stabilization pad means P be retracted to its initial position, the actuator assembly A is again affixed to the wireline 68 for lowering in the drill string D. However, prior to such action, the resilient material 76*e* is removed from the pawl resiliency means 76, however, leaving the positioning of the lower stop 86 and latch dog 90 of the programming means G and upper stop means 78 as before. As with above, the latch dog 90 and lower stop means 85 of the programming means G appropriately engage the actuator detent 18*d* and end surface 18*b* of the sleeve member 18 with consequent expansion of the upper stop means 78*a* in response to fluid pressure imposed on the drill string D at the surface. In this position, the upper stop means 78 is almost in engagement with annular lip 10*d* when fully pressurized. However, full pressurization results in a slight downward movement of the sleeve assembly S to move the spring dog 40 to a position as shown in FIG. 5C such that the point 40*c* is beyond the tip of pawl 34*s*. As such, the spring dog 40 moves radially inwardly in response to resilient member 46 inasmuch as there is no resilient material 76*e* to impede such motion. The radially inward movement of the spring dog 40 is sufficient to allow clearance of the tip 40*c* with that of the pawl 34*s* and pawl 34*r*. However, it should be noted that the interior surface 34*c* adjacent pawl 34*q* is of a smaller inside diameter than the corresponding pawls 34*r*, 34*s*, 34*t* such that the tip 40*c* will engage surface 34*d* as the actuator assembly A is drawn upwardly. Of course, such upward movement is not accomplished until the fluid pressure on the drill string D is removed at the surface allowing the resilient sleeve means 30*a* to snap the sleeve assembly S upwardly until the point 40*c* engages surface 34*d* of pawl 34*q* for retracting the stabilization pad means P to their laterally innermost positions. Thus, the downhole stabilizing tool T may be used multiple times between positions wherein the stabilization pad means P are fully expanded outwardly and fully retracted inwardly or intermediate thereof as the circumstances during the drilling operations may require. No removal of the downhole stabilizing tool T is necessary to accomplish these multiple position operations. All that is required is that the spacing between the upper stop means 78 and lower stop means 85 be such that the desired amount of movement laterally of the stabilization pad means P be accomplished.

As noted hereinabove, the downhole stabilizing tool T may be used with multiples of such tools T on one drill string D. In such an instance, it is desirable that any one of such series of tools be selectively actuated as is needed. Such is accomplished by preprogramming of the actuator assembly A with the predetermined distance between the end surface 18*b* and actuator detent 18*d* corresponding to a similar such distance between the lower stop means 85 and the latch means 88. As is shown in FIG. 2B, the latch dog 90 in addition to being mounted in slots 74*i*; could also be mounted in either slots 74*j* or slots 74*k*. Mounting the latch means 88 in slots 74*j* would result in a distance between the lower stop means 85 and latch means 88 greater than that if the latch means 88 were mounted in slots 74*k*. If, for example, the latch means 88 of FIG. 2B were mounted in slot 74*j*, no actuation of the downhole stabilizing tool T would occur for the distance would not be such that the latch means 88 could move into the actuator detent 18*d* while the lower stop means 85 engages the end surface 18*b* of sleeve member 18. Thus, by programming the distance between the lower stop means 85 and latch means 88, one of a series of downhole stabilizing tools T may be selectively engaged as is necessary. As before, by selecting the amount of vertical travel that the upper stop means 78 moves in response to fluid pressure until engagement with the annular lip 10*d*, the amount of corresponding vertical movement of the spring dog 40 is controlled, thus regulating the extent of lateral expansion of the stabilizing pad means P. Thus, it is possible that multiple stabilizing tools T may be used, with all having settings of the stabilizing pad means P as is necessary, with each of said series of stabilizing tools T adaptable to being retracted to positions wherein the stabilizing pad means P are at their innermost positions or at their outermost positions or any intermediate position based upon needs as they are encountered.

Thus, the downhole stabilizing tool T and actuator assembly A of the present invention provide a new and improved directional drilling tool and method for using same wherein once the downhole stabilizing tool T is mounted with the drill string D, such need not be removed during such drilling operations until complete, therefore eliminating significant down time for increased cost savings.

The foregoing disclosure and description of the invention are illustrative and explanatory thereof and various changes in the size, shape, and materials, as well as in the details of the illustrated construction, may be made within the scope of the appended claims without departing from the spirit of the invention.

I claim:

1. A downhole stabilizing tool for directional drilling and adapted to be used with a fluid conductive drill string in a borehole, comprising:

a tool housing adapted to be connected with the fluid conductive drill string and in fluid communication therewith, said tool housing formed having a tool housing bore therein;

a sleeve assembly mounted for movement within said tool housing bore for movement between selected positions, said sleeve assembly formed having camming means therewith;

stabilization pad means mounted with said tool housing for selective movement laterally of said tool housing for engagement with the borehole, said stabilization pad means having cam engaging means therewith for engaging said camming means of said sleeve assembly for moving said stabilization pad means radially in response to movement of said sleeve assembly between said selected positions;

pawl means mounted with said tool housing bore and adapted to cooperate with said sleeve assembly for limiting movement of said sleeve assembly to said selected positions; and, pawl engaging means with said sleeve assembly for engaging said pawl means for limiting movement of said sleeve assembly to said selected positions.

2. The tool of claim 1, wherein:

said camming means of said sleeve assembly includes a camming surface; and, said cam engaging means of said stabilization pad means includes a cam surface for compatibly engaging said camming surface.

3. The tool of claim 1, wherein:

said sleeve assembly has an upper end and is mounted for resilient reciprocal movement within said tool housing bore and includes resilient mounting disposed between said pawl means and said upper end for permitting said resilient reciprocal movement.

4. The tool of claim 1, wherein:

said pawl means includes a plurality of pawl members adapted to be circumferentially disposed about said tool housing bore.

5. The tool of claim 4, wherein:

each of said pawl members includes at least two pawls for receiving said pawl engaging means for limiting movement of said sleeve assembly to said selected positions.

6. The tool of claim 1, wherein:

said pawl engaging means includes at least one spring dog movably mounted with said sleeve assembly.

7. The tool of claim 6, wherein:

said spring dog is mounted for limited radially pivotal movement with said sleeve assembly.

8. The tool of claim 7, wherein:

said spring dog includes bias means for biasing said spring dog radially inwardly.

9. The tool of claim 1, further including:

actuator assembly adapted to be programmed and selectively positioned within said tool housing bore for moving said sleeve assembly between said selected positions.

10. The tool of claim 9, wherein:

said actuator assembly includes programming means therewith for cooperatively engaging said sleeve assembly for movement thereof between said selected positions.

11. The tool of claim 10, wherein:

an actuator detent is formed adjacent said upper end of said sleeve assembly for receiving said actuator assembly.

12. The tool of claim 11, wherein:

said actuator detent is formed a predetermined distance from said upper end of said sleeve assembly; and, said actuator assembly includes lower stop means and latch means, said latch means for engaging said actuator detent and said lower stop means for engaging said upper end of said sleeve member when said lower stop means is said predetermined distance from said actuator detent and said latch means engages said actuator detent.

13. The tool of claim 12, wherein:

said actuator assembly includes a piston body member adapted to be positioned within said sleeve assembly;

said lower stop means includes at least one lower stop mounted for radial movement with respect to said piston body member; and, said latch means includes at least one latch dog mounted for radial movement with respect to said piston body member.

14. The tool of claim 13, wherein:

said lower stop is pivotally mounted with said piston body member adjacent the upper portion thereof; and, said latch dog is pivotally mounted with said piston body member adjacent the central position thereof.

15. The tool of claim 14, wherein:

said latch dog is mountable with said piston body member at multiple preselected positions corresponding to multiple of said predetermined distances of said actuator detent from said upper end of said sleeve member.

16. The tool of claim 14, wherein:

said piston body member is formed having a piston body member bore therethrough; and, said actuator assembly includes a piston assembly mounted for movement within said piston body member bore for engaging said latch dog and said lower stop.

17. The tool of claim 16, wherein:

said piston assembly includes a lower stop engaging surface and a latch dog engaging surface, said latch dog engaging surface for engaging said latch dog for moving said latch dog pivotally radially outwardly and said lower stop engaging surface for engaging said lower stop for moving said lower stop pivotally radially outwardly.

18. The tool of claim 17, further including:

urging means disposed between said piston body member bore and said piston assembly for urging said piston assembly into said latch dog for biasing said latch dog for radially outwardly movement.

19. The tool of claim 18, wherein:

said lower stop is pivotal between a retracted and an expanded position, said actuator assembly including lower stop bias means with said piston body member for biasing said lower stop in said retracted position, said lower stop movable to said expanded position assembly in opposition to said lower stop bias means when said lower stop is said predetermined distance from said actuator detent and said latch dog engages said actuator detent.

20. The tool of claim 19, further including:

forcing means with the drill string for forcing said lower stop downwardly into engagement with said upper end of said sleeve member for urging said sleeve assembly to said selected positions.

21. The tool of claim 20, further including:

resilient sleeve means disposed between said pawl means and said upper end of said sleeve assembly for permitting resilient reciprocal movement of said sleeve assembly within said tool housing bore, said forcing means capable of overcoming said resilient sleeve means for moving said sleeve assembly between said selected positions.

22. The tool of claim 11, further including:

said actuator assembly includes a piston body member adapted to be positioned within said sleeve assembly, said piston body member having an upper position;

upper stop means with said actuator assembly for limiting movement of said sleeve assembly to specific distances between said selected position; and, spacer means with said upper portion of said piston body member for spacing said upper stop means from said lower stop means said specific distances.

23. The tool of claim 22, wherein:

said upper stop means includes an upper stop mounted with a stop body member for radial movement with respect to said stop body member, said stop body member adapted to be mounted about an upper portion of said spacer means.

24. The tool of claim 23, wherein:

said stop body member is mounted for reciprocal movement about said upper end of said spacer means for movement between a first position wherein said upper stop is in a retracted position and a second position wherein said upper stop is in an expanded position with respect to said stop body member.

25. The tool of claim 24, further including:

seal means with said spacer means for sealably engaging said tool housing bore in a fluid tight relation for permitting fluid pressure within the fluid conductive string to move said stop body member from said first position to said second position.

26. The tool of claim 25, wherein:

said spacer means engages said upper stop for moving said upper stop pivotally radially outwardly when said stop body member moves from said first position to said second position.

27. The tool of claim 24, further including:

resilient upper stop means for biasing said stop body member in said first position.

28. The tool of claim 9, wherein:

said actuator assembly includes pawl resiliency means mounted with said actuator assembly for biasing said pawl engaging means outwardly.

29. The tool of claim 22, wherein:

said pawl resiliency means is removably mounted with said actuator means as desired.

30. In a downhole stabilizing tool having plural stabilization pads movable between preselected radial positions for directional drilling and adapted to be used with a fluid conductive string in a borehole, an actuator assembly for actuating the stabilizing tool to move the stabilization pads to the preselected positions by engaging surfaces, comprising:

a piston body member adapted to be positioned within the stabilizing tool;

programming means with said piston body member a spaced apart programmed distance for cooperatively engaging the compatibly formed engaging surfaces of the stabilizing tool that are also spaced apart a programmed distance for moving the stabilization pads between the preselected positions; and said programming means includes lower stop means and latch means mounted with said piston body member, said lower stop means spaced apart from said latch means said programmed distance.

31. The actuator assembly of claim 30, wherein:

said lower stop means includes a lower stop mounted for radial movement with said piston body member; and, said latch means includes a latch dog mounted for radial movement with said piston body member and spaced apart from said lower stop said programmed distance.

32. The actuator assembly of claim 31, wherein:

said piston body member is formed having a piston body member bore therethrough; and, a piston assembly is mounted for movement within said piston body member bore for engaging said latch dog and said lower stop.

33. The actuator assembly of claim 32, wherein:

said latch dog is mounted for pivotal movement with said piston body member between a primary position wherein said latch dog is radially inwardly and a secondary position wherein said latch dog is radially outwardly;

said lower stop is mounted for pivotal movement with said piston body member between an initial position wherein said lower stop is radially inwardly and a final position wherein said lower stop is radially outwardly;

said piston assembly is mounted for reciprocal movement within said piston body member bore between a lower position when said latch dog is in said primary position and an upper position when said latch dog is in said secondary position and said lower stop is in said final position.

34. The actuator assembly of claim 33, further including:

bias means with said piston body member for biasing said piston assembly for movement from said lower position to said upper position.

35. The actuator assembly of claim 33, wherein:

said latch dog is mountable with said piston body member at multiple preselected positions for effectuating multiple programming of said piston body member within the stabilizing tool.

36. The actuator assembly of claim 33, further including:

lower stop resilient means with said piston body member for maintaining said lower stop in said initial position until said piston assembly is movable to said upper position.

37. The actuator assembly of claim 33, further including:

upper stop means with said piston body member for limiting movement of the stabilization pads to the preselected positions when said piston assembly is in said upper position; and, spacer means mounted with said upper portion of said piston body member and having said upper stop means therewith, said spacer means spacing said upper stop means from said lower stop a defined distance permitting movement of the stabilization pads between the preselected radial position.

38. The actuator assembly of claim 37, wherein:

said upper stop means includes an upper stop mounted with a stop body member for radial movement with respect to said stop body member, said stop body member adapted to be mounted about an upper portion of said spacer means.

39. The actuator assembly of claim 38, wherein:

said stop body member is mounted for reciprocal movement about said upper end of said spacer means for movement between a first position wherein said upper stop is in a retracted position and a second position wherein said upper stop is in an expanded position.

40. The actuator assembly of claim 39, further including:

seal means with said spacer means for sealably engaging said tool housing bore in a fluid tight relation for permitting fluid pressure within the fluid conductive string to move said stop body member from said first position to said second position.

41. The actuator assembly of claim 40, wherein:

said spacer means engages said upper stop for moving said upper stop pivotally radially outwardly when said stop body member moves from said first position to said second position.

42. The actuator assembly of claim 38, further including:

resilient upper stop means for biasing said stop body member in said first position.

43. A method for actuating plural stabilization pads of a downhole stabilizing tool for moving the stabilization pads between preselected lateral positions for directional drilling, the downhole stabilizing tool adapted to be used with a fluid conductive drill string in a borehole, comprising the steps of:

selecting a predetermined distance between an upper end and an actuator detent of a sleeve assembly of the stabilizing tool;

mounting the stabilizing tool with the fluid conductive drill string;

preprogramming an actuator assembly to correspond with the predetermined distance of said selecting;

running the actuator assembly through the fluid conductive string adjacent to the stabilizing tool;

selectively engaging the stabilizing tool with the actuator assembly as a result of said preprogramming; and expanding by fluid pressure action the stabilization pads of the stabilizing tool outwardly into the borehole after said selectively engaging.

44. The method of claim 43, wherein said preprogramming includes the step of:

mounting a lower stop and a latch dog with the actuator assembly, the lower stop being mounted the predetermined distance from the latch dog.

45. The method of claim 43, further including the step of:

forcing the actuator assembly with fluid pressure on the fluid conductive string into engagement with the stabilizing tool after said selectively engaging to effectuate said expanding.

46. The method of claim 43, further including the steps of:

withdrawing the actuator assembly from the stabilizing tool and the fluid conductive drill string;

removing the resilient member from the actuator assembly;

rerunning the actuator assembly through the fluid conductive drill string adjacent the stabilizing tool;

selectively reengaging the stabilizing tool with the actuator assembly as a result of said preprogramming; and, withdrawing the stabilization pads of the stabilizing tool radially inwardly from the borehole.

47. The method of claim 46, further including the steps of:

rewithdrawing the actuator assembly from the stabilizing tool and the fluid conductive string;

resecuring the resilient member with the actuator assembly;

again rerunning the actuator assembly through the fluid conductive string adjacent the stabilizing tool;

selectively reengaging the stabilizing tool for a third time with the actuator assembly as a result of said preprogramming; and, reexpanding the stabilization pads of the stabilizing tool outwardly into the borehole to a selected distance.

48. In a downhole stabilizing tool having plural stabilization pads movable between preselected radial positions for directional drilling and adapted to be used with a fluid conductive string in a borehole, an actuator assembly for actuating the stabilizing tool to move the stabilization pads to the preselected positions by engaging surfaces, comprising:

a piston body member adapted to be positioned within the stabilizing tool;

programming means with said piston body member a spaced apart programmed distance for cooperatively engaging the compatibly formed engaging surfaces of the stabilizing tool that are also spaced apart a programmed distance for moving the stabilization pads between the preselected positions; and, pawl resiliency member mounted with said piston body member adapted to engage the stabilizing tool as necessary.

49. The actuator assembly of claim 48, wherein:

said pawl resiliency member is removably mounted with said piston body member.

* * * * *